United States Patent [19]

Hardouin

[11] 4,079,610

[45] Mar. 21, 1978

[54] APPARATUS FOR STRETCHING EXTRUDED LENGTHS OF METAL

[75] Inventor: Jean Pierre Hardouin, Luisant, France

[73] Assignee: Alcan Research and Development Limited, Montreal, Canada

[21] Appl. No.: 743,078

[22] Filed: Nov. 18, 1976

[30] Foreign Application Priority Data

Nov. 20, 1975 United Kingdom ..... 47895/75

[51] Int. Cl.[2] ..... B21D 3/12; B21D 25/04

[52] U.S. Cl. ..... 72/14; 72/256; 72/302; 72/305; 72/378

[58] Field of Search ..... 72/302, 305, 306, 311, 72/307, 308, 317, 318, 295, 14, 15, 31, 32, 378, 379, 256, 294, 392; 140/108, 147

[56] References Cited

U.S. PATENT DOCUMENTS

| | | | |
|---|---|---|---|
| 187,957 | 3/1877 | Baldwin | 72/302 X |
| 2,136,538 | 11/1938 | Borwick | 72/302 X |
| 3,739,619 | 6/1973 | Follrath | 72/392 |

FOREIGN PATENT DOCUMENTS

| | | | |
|---|---|---|---|
| 149,581 | 1/1953 | Australia | 72/392 |
| 385,984 | 3/1965 | Switzerland | 72/392 |

*Primary Examiner*—C. W. Lanham
*Assistant Examiner*—D. M. Gurley
*Attorney, Agent, or Firm*—Cooper, Dunham, Clark, Griffin & Moran

[57] ABSTRACT

An apparatus for stretching an extruded length of metal comprises a plurality of sets of tailstock jaws mounted at fixed positions in line with and spaced from each other, and a set of headstock jaws mounted in line with the sets of tailstock jaws and movable towards and away from the sets of tailstock jaws by a motor. The sets of tailstock jaws are individually controlled by respective sensors which when energized emit a signal in response to the presence of the trailing end of an extruded length of metal travelling past the sets of tailstock jaws, and the sensor signal actuates closure of the associated tailstock jaws on the trailing end of the extruded length.

2 Claims, 10 Drawing Figures

APPARATUS FOR STRETCHING EXTRUDED LENGTHS OF METAL

This invention relates to apparatus for stretching an extruded length of metal and has a particularly useful but not exclusive application in relation to the extrusion of aluminium, the stretching serving to straighten the extruded length.

According to the invention there is provided apparatus for stretching an extruded length of metal, comprising a plurality of sets of tailstock jaws mounted at fixed positions in line with each other lengthwise of an extrusion each of which sets is operable to grip an end portion of an extrusion, a set of headstock jaws disposed in alignment with the sets of tailstock jaws and spaced therefrom, which headstock jaws are operable to grip and release an end of an extruded length, and motor means for moving the headstock jaws towards and away from the sets of tailstock jaws.

According to a preferred feature of the invention a sensor is disposed adjacent each set of tailstock jaws and is adapted to emit a signal when the trailing end of an extrusion moved by the headstock jaws (the leading end of the extrusion being gripped in the headstock jaws) reaches a predetermined position with respect to the adjacent set of tailstock jaws, which signal operates to stop the movement of the headstock jaws by the motor means and initiates operation of the said adjacent tailstock jaws to grip said extrusion.

Figures 1, 2, 3, 4, 5:
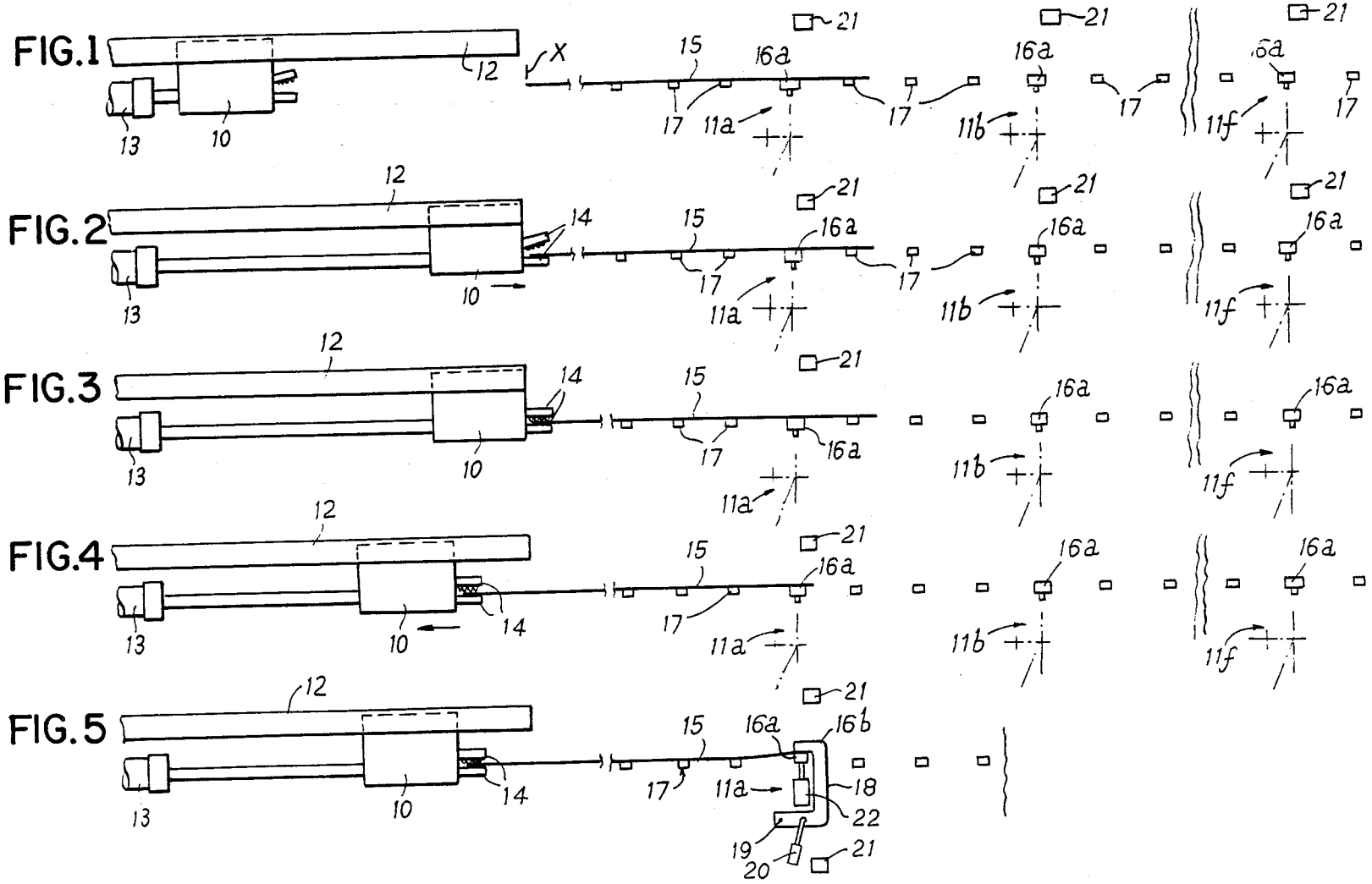
Figures 6, 7, 8, 9, 10:
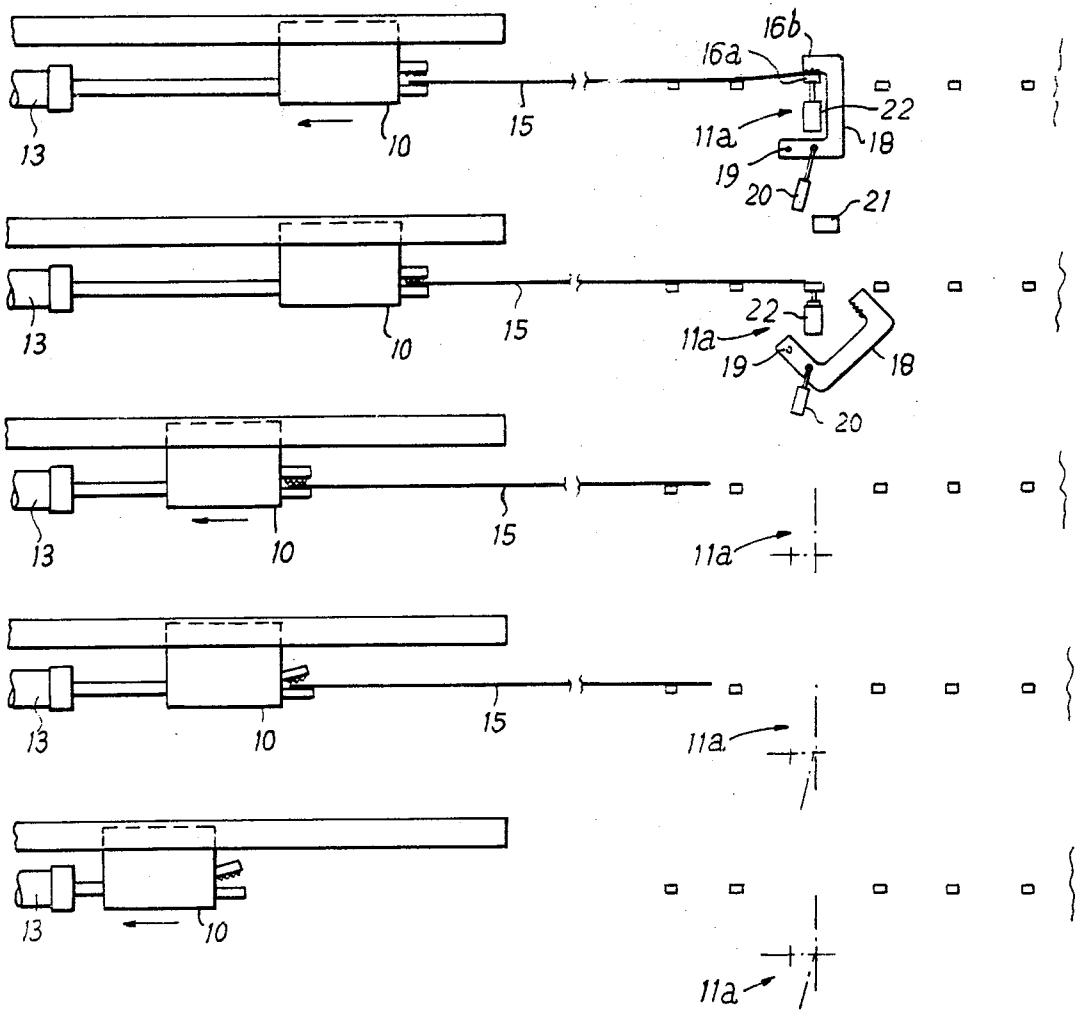

One embodiment of the invention will now be described in more detail by way of example. The description makes reference to the accompanying diagrammatic drawing showing 10 steps in the cycle of operation of one form of apparatus according to the invention wherein FIGS. 1–10, respectively, represent the 10 steps. In the following description reference to positions 1, 2, 3, . . . 10, will be understood to refer to the correspondingly numbered figures.

The illustrated apparatus is arranged to apply a stretching force automatically to an extrusion of any length within the capacity of the machine. Referring to the drawing the apparatus includes a headstock 10 and a series of sets of tailstock units 11*a*, 11*b*, 11*c* and so on, (only the positions of which are for the most part shown in the drawing). The tailstock units and the headstock are in line with each other, and a support table 17 for supporting the extrusion extends from the headstock unit past all the tailstock units. In the present instance the tailstock units are 4 meters apart and six units 11*a* to 11*f* are provided.

The headstock 10 is mounted on an overhead rail 12 for guided movement towards and away from the tailstock units by a hydraulic piston and cylinder motor 13. The headstock has a pair of jaws 14 which are operable to grip and release one end of an extrusion which is indicated at 15. The range of movement of the headstock is 5 meters in this instance.

Each of the tailstock units 11*a* to 11*f* comprises (see positions 5, 6 and 7) a pair of jaws 16*a*, 16*b* of which the jaw 16*a* is disposed just below the support table 17 for the extrusion 15 and is movable vertically to a position a little above the level of the support table by a hydraulic actuator 22. The other jaw 16*b* is carried by an arm 18 mounted for swivelling movement about a fixed pivot 19 between a lowered inoperative position and a raised operative position by a hydraulic actuator 20. Associated with each tailstock unit is a sensor 21 for sensing the trailing end of an extrusion, and the arrangement is such that the jaws operate in sequence, jaw 16*b* being first raised into its upright position by actuator 20 and jaw 16*a* being then lifted to apply the clamping action.

In operation of the apparatus the jaws 16*a*, 16*b* of all the tailstock units are in their inoperative positions initially, and an aluminium extrusion is fed on to the support table and is disposed with one end in a datum position X at the forward end of the travel of the headstock as shown in positions 1 to 3 in the drawing. The extrusion can be of any length such that its other end is between the jaw 16*a* of tailstock unit 11*a* and a position approximately 4 meters beyond the jaw 16*a* of the last tailstock unit of the series, which in this instance is the sixth unit ll*f*. The headstock is moved forward by its motor 13 as shown in position 2 in the drawing and the end of the extrusion is gripped by the jaws 14 (position 3). The sensors 21 are then energised, and the motor 13 is reversed to move the headstock and extrusion rearwards. The first sensor 21 past which the trailing end of the extrusion moves (the sensor adjacent tailstock unit 11*a* in the illustrated example) emits a signal which causes the motor 13 of the headstock to be stopped with the trailing end of the extrusion on the lower jaw 16*a* of the associated unit 11*a* as shown in position 4. The signal also causes the jaws of the tailstock unit 11*a* to be actuated to grip the end of the extrusion as shown in position 5, upper jaw 16*b* being first raised into its operative position and the lower jaw 16*a* being then moved upward toward the upper jaw above the level of the support table, thus lifting the trailing end of the extrusion clear of the support table and clamping the extrusion. The motor 13 of the headstock is then re-started to move the headstock rearward to stretch the extrusion (position 6). When the extrusion has been stretched to the required degree, motor 13 is stopped and the jaws of the tailstock unit are opened (position 7). Motor 13 is then re-started drawing the extrusion leftward to a predetermined position (position 8), the jaws of the headstock are opened (position 9) and the headstock is moved leftward clear of the extrusion to enable the extrusion to be removed from the support table (position 10).

The illustrated machine is thus capable of handling a wide range of lengths of extrusion speedily and completely automatically and is thus very advantageous over arrangements in which a single set of tailstock jaws is moved manually lengthwise of the support table to match its position to the length of the extrusion which is to be stretched.

It will be understood that several extrusions can be dealt with simultaneously by the headstock and tailstock unit, for use with extruders having multiple extrusion dies, the extrusions being all the same length.

I claim:

1. Apparatus for stretching an extruded length of metal, comprising a plurality of sets of tailstock jaws mounted at fixed positions in a straight line each of which sets is operable to grip an end portion of said extruded length, a set of headstock jaws disposed on a continuation of said straight line which headstock jaws are operable to grip and release an end of said extruded length, motor means for moving the headstock jaws along said line toward and away from the sets of tailstock jaws, and respective sensors individually controlling the sets of tailstock jaws, each sensor being adapted to emit a signal in response to the presence of the trailing end of an extruded length drawn past the sets of tailstock jaws by the headstock jaws, which signal actuates stopping of the movement of the headstock jaws and closure of the set of tailstock jaws controlled by that sensor on the trailing end of the extruded length whereby further movement of the headstock jaws away from the tailstock jaws stretches said extruded length.

2. Apparatus as claimed in claim 1, wherein a support table supports the extruded length and each set of tailstock jaws comprises an upper jaw and a lower jaw, the lower jaw when clamped on the extruded length being disposed above the support table.

* * * * *